US007540770B2

(12) United States Patent
Ishizuka et al.

(10) Patent No.: US 7,540,770 B2
(45) Date of Patent: Jun. 2, 2009

(54) ELECTRICAL CONNECTOR

(75) Inventors: Shinya Ishizuka, Tokyo (JP); Kazuyuki Ozai, Tokyo (JP); Hirokazu Takahashi, Tokyo (JP); Akio Yamada, Noda (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/637,463

(22) Filed: Dec. 11, 2006

(65) Prior Publication Data

US 2007/0155227 A1 Jul. 5, 2007

(30) Foreign Application Priority Data

Dec. 27, 2005 (JP) ..... 2005-375566

(51) Int. Cl.
*H01R 13/60* (2006.01)

(52) U.S. Cl. ..... 439/570; 439/353

(58) Field of Classification Search ..... 439/570, 439/353, 357, 358, 378, 566, 563
See application file for complete search history.

(56) References Cited

U.S. PATENT DOCUMENTS 5,167,528 A * 12/1992 Nishiyama et al. ..... 439/489
5,199,884 A * 4/1993 Kaufman et al. ..... 439/74
5,356,300 A * 10/1994 Costello et al. ..... 439/101
5,697,799 A * 12/1997 Consoli et al. ..... 439/181
5,921,787 A * 7/1999 Pope et al. ..... 439/74
5,931,689 A * 8/1999 Patel ..... 439/346
6,007,352 A * 12/1999 Azuma et al. ..... 439/108
6,074,249 A * 6/2000 Beken et al. ..... 439/567
6,343,951 B1 * 2/2002 Ono et al. ..... 439/571
6,500,013 B1 * 12/2002 Wang ..... 439/108
6,645,005 B2 * 11/2003 Wu ..... 439/563
6,726,492 B1 * 4/2004 Yu ..... 439/108
6,767,251 B2 * 7/2004 Yu et al. ..... 439/607

* cited by examiner

*Primary Examiner*—T C Patel
*Assistant Examiner*—Vladimir Imas
(74) *Attorney, Agent, or Firm*—Abelman, Frayne & Schwab

(57) ABSTRACT

An electrical connector detachably fitted with a mating connector includes a plurality of contacts, a housing arranging and holding the contacts therein and having guide portions for guiding the mating connector, and fixtures to be fixed to a substrate. The fixtures are made of a metal and each include the guide portion in the form of a substantially U-shape integrally formed therewith. A free end of the guide portion is provided on each of its both sides with an extending piece downwardly extending and adapted to be inserted into an inserting groove of the housing. The housing is provided with the inserting grooves at locations corresponding to the extending pieces for inserting the extending pieces, respectively, and is provided with slits, one at each of its longitudinal ends, to form holding portions having elasticity, thereby holding the guide portions of the fixtures therein. The guide portions of the electrical connector are not damaged even if being subjected to unexpected strong forces from the mating connector.

8 Claims, 6 Drawing Sheets

ELECTRICAL CONNECTOR

BACKGROUND OF THE INVENTION

This invention relates to an electrical connector for use in electric and electronic appliances such as servers and the like, and more particularly to an electrical connector which is able to resist to unexpected strong forces when being fitted with a mating connector.

An electrical connector 60 as a prior art electrical connector will be explained with reference to FIGS. 7A and 7B. FIG. 7A is a perspective view of the electrical connector of the prior art viewed from the side of its fitting portion, and FIG. 7B is a perspective view of the electrical connector shown in FIG. 7A viewed from the side of its connection portion. The electrical connector 60 of the prior art is to be connected to a substrate, while its mating connector is to be connected to cables. The electrical connector 60 of the prior art comprises a housing 62, contacts 64, and fixtures 66.

In the electrical connector 60 of the prior art, the housing 62 is integrally provided with guide portions 68, one at each of both longitudinal ends, for guiding the mating connector 80. There is no relevant patent literature to be incorporated herein within the scope of our research.

When the electrical connector 60 mounted on the substrate and the mating connector 80 connected to cables are being fitted with each other, it is difficult to insert the mating connector 80 with the cables into said electrical connector 60 correctly without being tilted relative to each other. Therefore, the guide portions 68 may be provided on the housing 62.

However, the guide portions 68 of said electrical connector 60 are frequently subjected to unexpected strong forces due to incorrect insertion of the mating connector 80. When being subjected to such forces, said guide portions 68 integrally formed with the housing 62 are likely to be damaged. Such a problem remains to be solved.

SUMMARY OF INVENTION

In view of the problems of the prior art, it is an object of the invention to provide an electrical connector whose guide portions are not damaged even if being subjected to unexpected strong forces from a mating connector when being fitted with the electrical connector.

The object of the invention as described above can be accomplished by the electrical connector 10 according to the invention detachably fitted with a mating connector 80, including a plurality of contacts 14, a housing 12 arranging and holding said contacts 14 therein and having guide portions for guiding said mating connector 80, and fixtures 16 to be fixed to a substrate, wherein said fixtures 16 are made of a metal and each comprise said guide portion 40 in the form of a substantially U-shape integrally formed therewith, a free end of said guide portion 40 being provided on each of its both sides with an extending piece 44 downwardly extending and adapted to be inserted into an inserting groove 28 of said housing 12, and said housing 12 is provided with said inserting grooves 28 at locations corresponding to said extending pieces 44 for inserting said extending pieces 44, respectively, and is provided with slits 32, one at each of its longitudinal ends, to form holding portions 26 having elasticity, in which said guide portions 40 of said fixtures 16 are held, respectively.

According to a preferred embodiment of the invention, said mating connector 80 is provided with anchoring portions 82, and said fixtures 16 are each provided with engaging portion 41 which engages said anchoring portion 82 of said mating connector 80, thereby securely locking said mating connector 80.

Moreover, preferably said extending pieces 44 of said fixtures 16 are extended through said inserting grooves 28 of said housing 12 and tips of said extending pieces 44 extending from the housing are each provided with a connection portion 42 to be connected to the substrate.

As can be seen from the above description, the electrical connector according to the invention can bring about the following significant functions and effects.

(1) In an electrical connector detachably fitted with a mating connector 80, including a plurality of contacts 14, a housing 12 arranging and holding said contacts 14 therein and having guide portions for guiding said mating connector 80, and fixtures 16 to be fixed to a substrate, according to the invention said fixtures 16 are made of a metal and each comprise said guide portion 40 in the form of a substantially U-shape integrally formed therewith, a free end of said guide portion 40 being provided on each of its both sides with an extending piece 44 downwardly extending and adapted to be inserted into an inserting groove 28 of said housing 12, and said housing 12 is provided with said inserting grooves 28 at locations corresponding to said extending pieces 44 for inserting said extending pieces 44, respectively, and is provided with slits 32, one at each of its longitudinal ends, to form holding portions 26 having elasticity, in which said guide portions 40 of said fixtures 16 are held, respectively. Consequently, even if the guide portions 40 are subjected to unexpected strong forces by the mating connector 80, the guide portions 40 are not damaged so that stable electrical connection can be obtained.

(2) According to the invention, said mating connector 80 is provided with anchoring portions 82, and said fixtures 16 are each provided with engaging portion 41 which engages said anchoring portion 82 of said mating connector 80, thereby securely locking said mating connector 80. Therefore, the mating connector 80 can be securely locked, upon the electrical connector and the mating connector being fitted with each other, and hence stable electrical connection can be obtained.

(3) According to the invention, said extending pieces 44 of said fixtures 16 are extended through said inserting grooves 28 of said housing 12 and tips of said extending pieces 44 extending from the housing 12 are each provided with a connection portion 42 to be connected to the substrate. Therefore, the guide portions 40 are never damaged, and the guide portions 40 are each fixed to the substrate at three points so that the mounting of the electrical connector onto the substrate is reliably achieved.

The invention will be more fully understood by referring to the following detailed specification and claims taken in connection with the appended drawings.

DESCRIPTION OF THE PREFERRED EMBODIMENTS

Figure 1A:
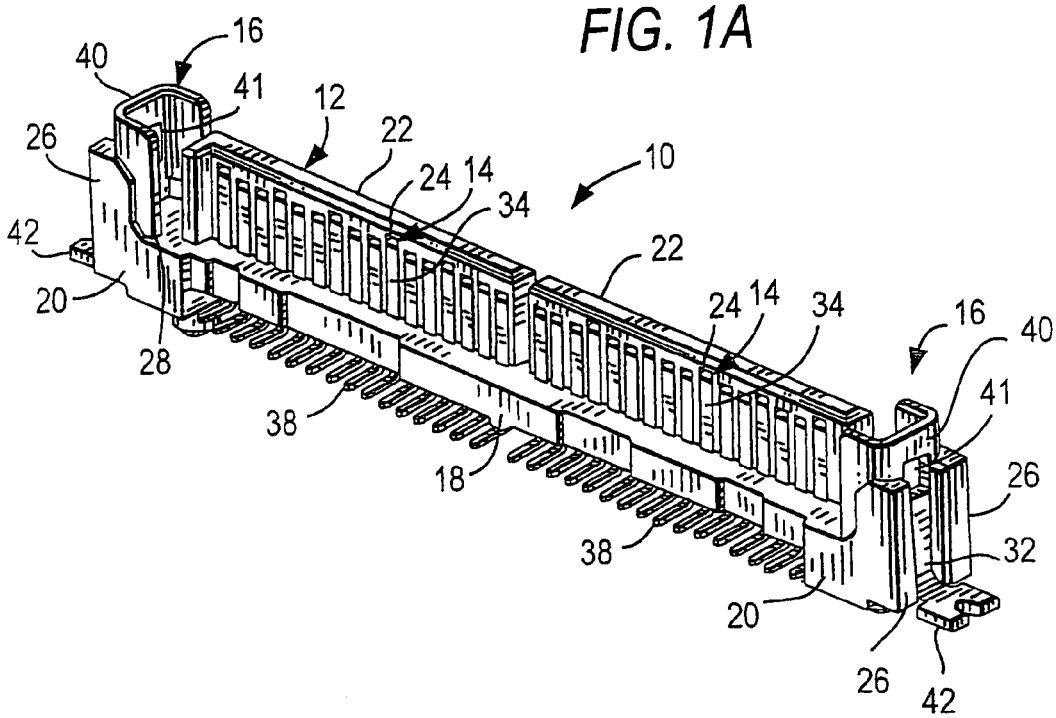
FIG. 1A is a perspective view of the electrical connector according to the invention viewed from the side of its fitting portion.
Figure 1B:
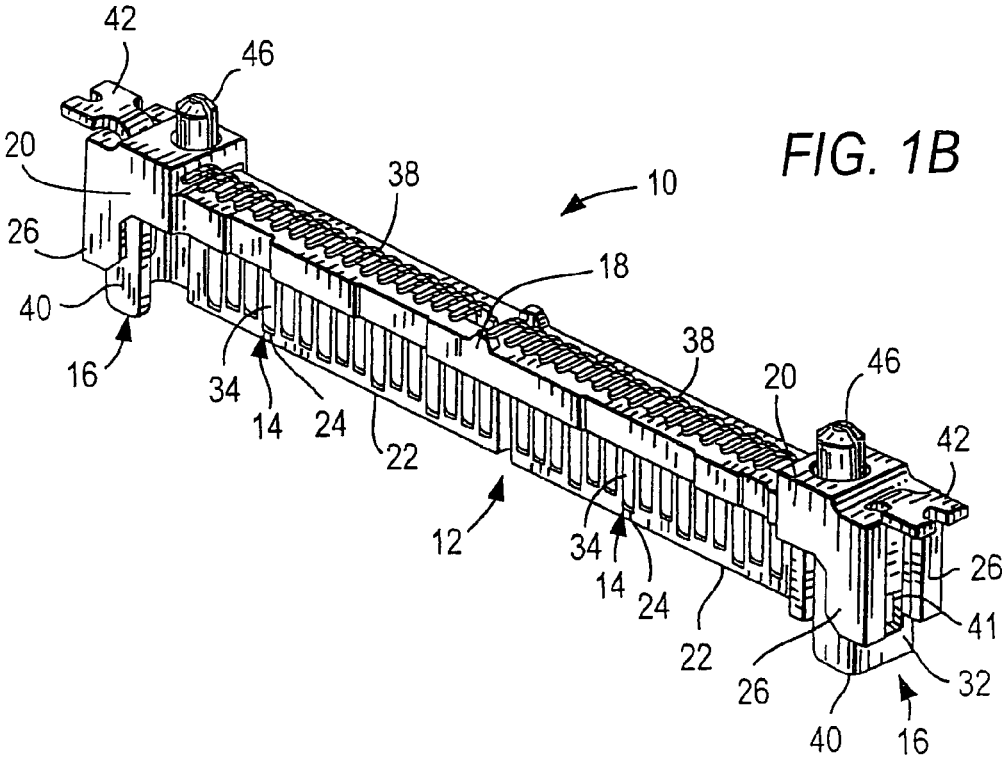
FIG. 1B is a perspective view of the electrical connector according to the invention viewed from the side of the connection portion.
Figure 2:
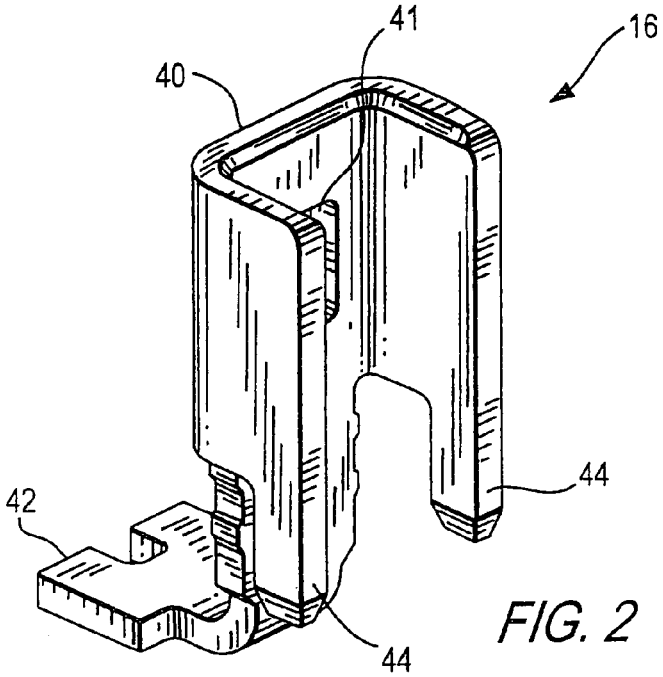
FIG. 2 is a perspective view of the fixture.
Figure 3:
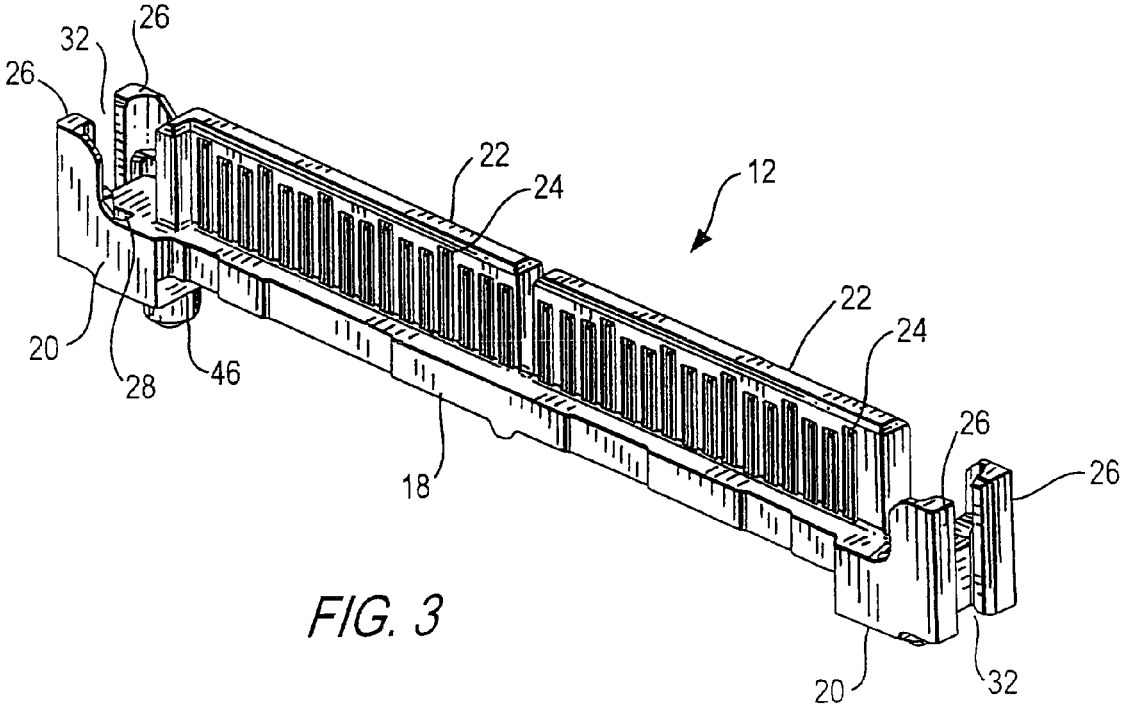
FIG. 3 is a perspective view of the housing.
Figure 4:
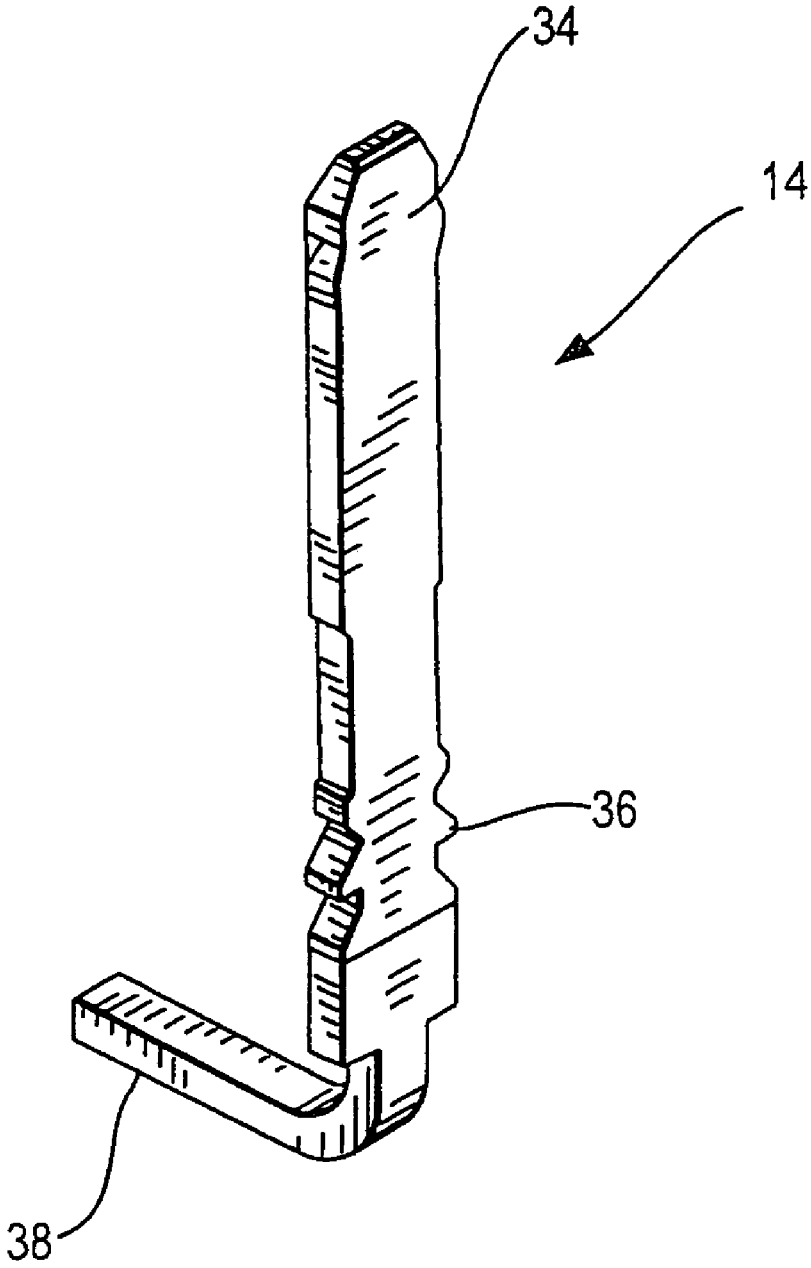
FIG. 4 is a perspective view of the contact.
Figure 5A:
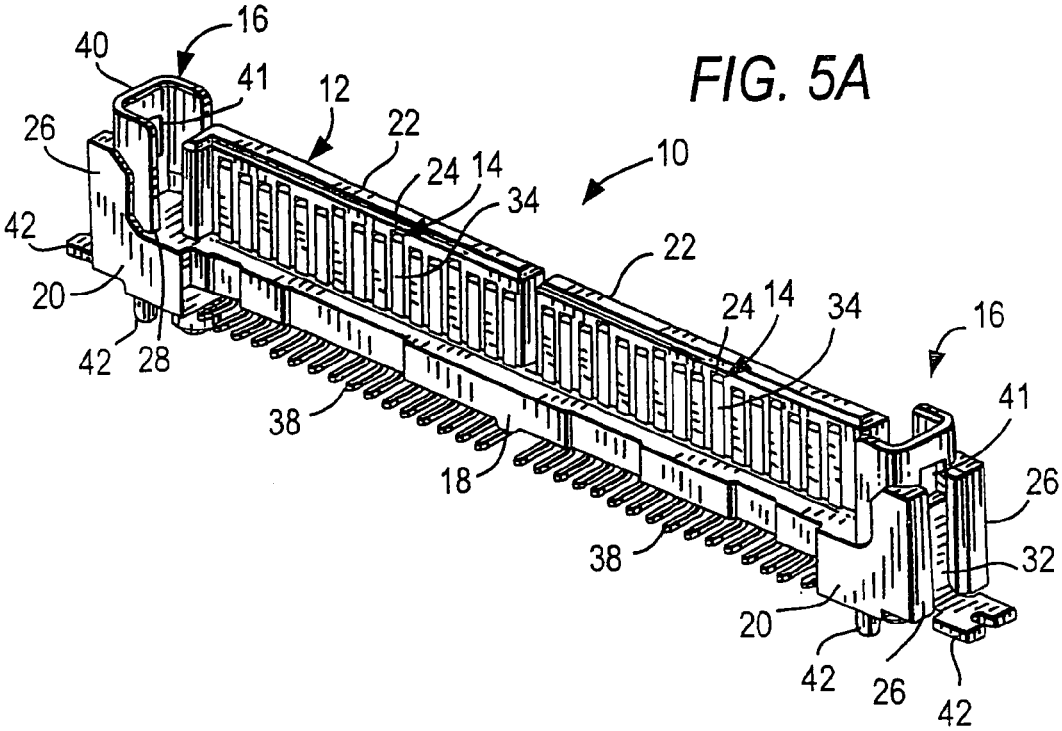
FIG. 5A is a perspective view of the electrical connector using fixtures of another type according to the invention viewed from the side of its fitting portion.
Figure 5B:
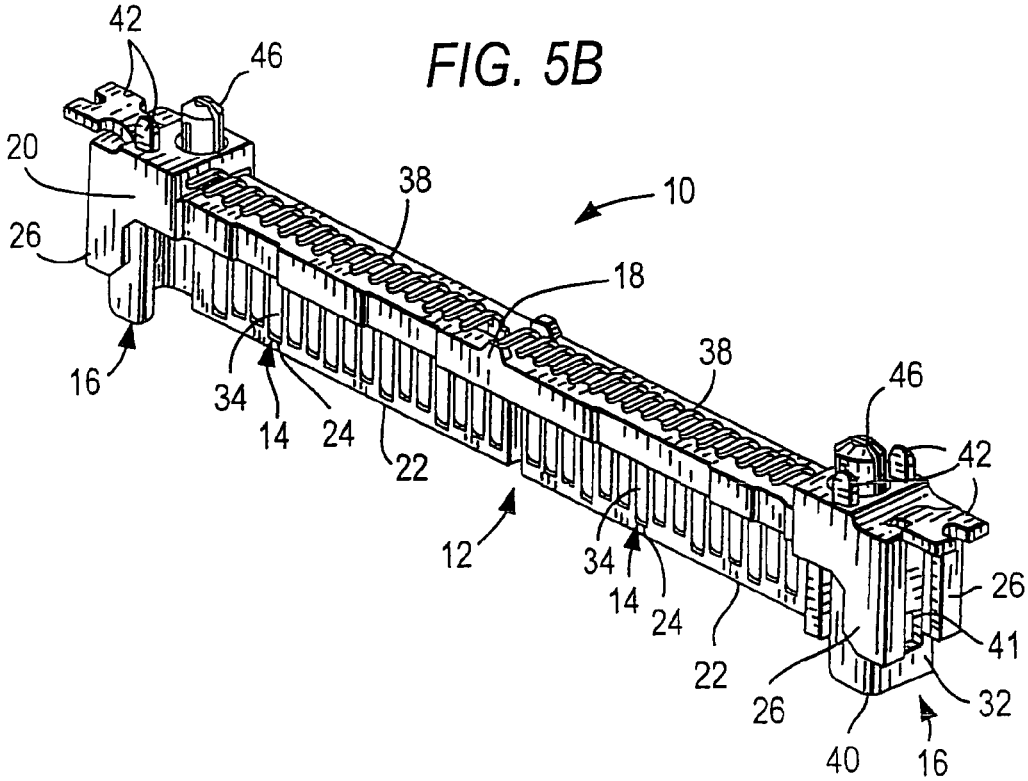
FIG. 5B is a perspective view of the electrical connector shown in FIG. 5A viewed from the side of the connection portion.
Figure 6:
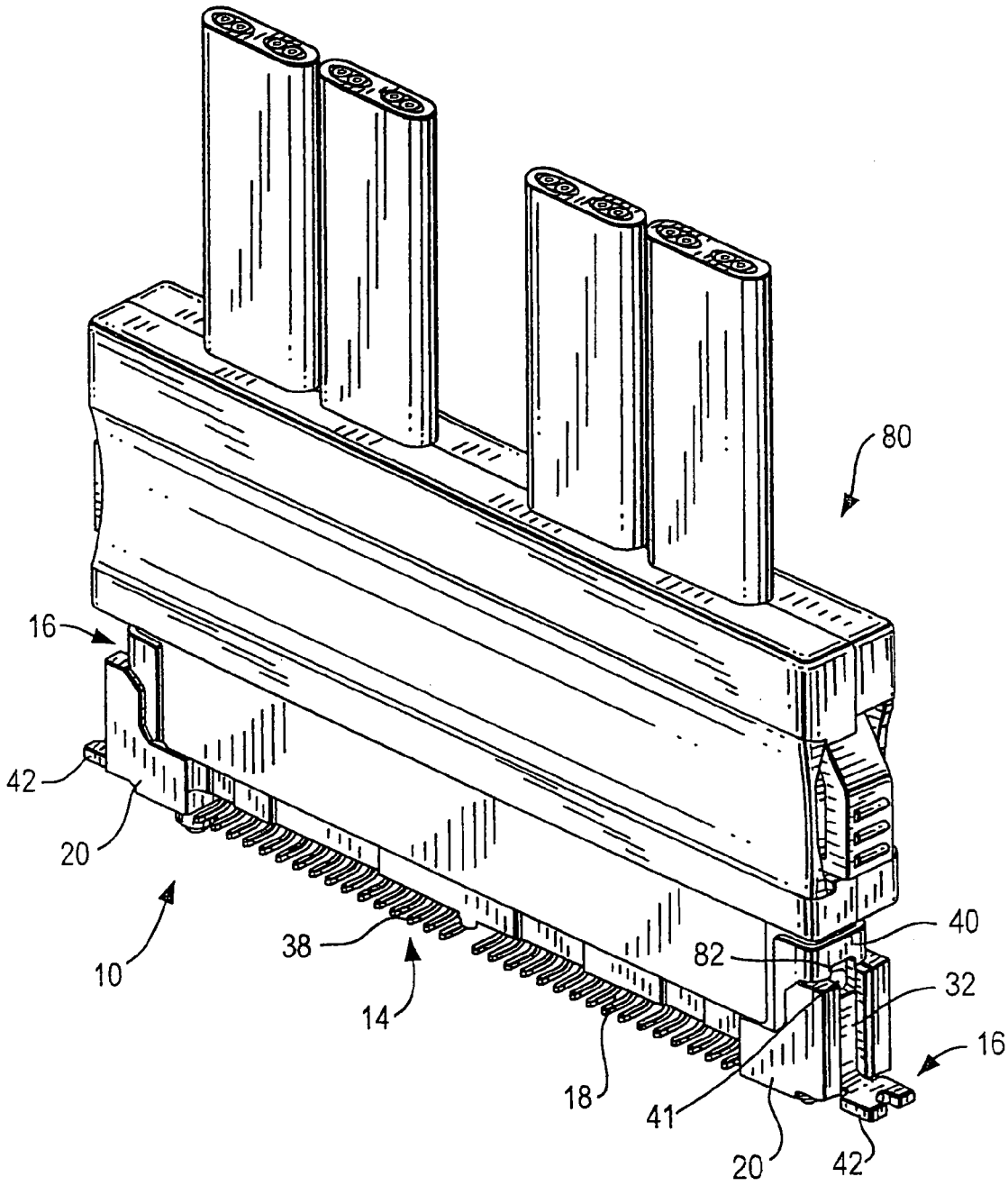
FIG. 6 is a perspective view illustrating the electrical connector according to the invention which has been fitted with a mating connector.
Figure 7A:
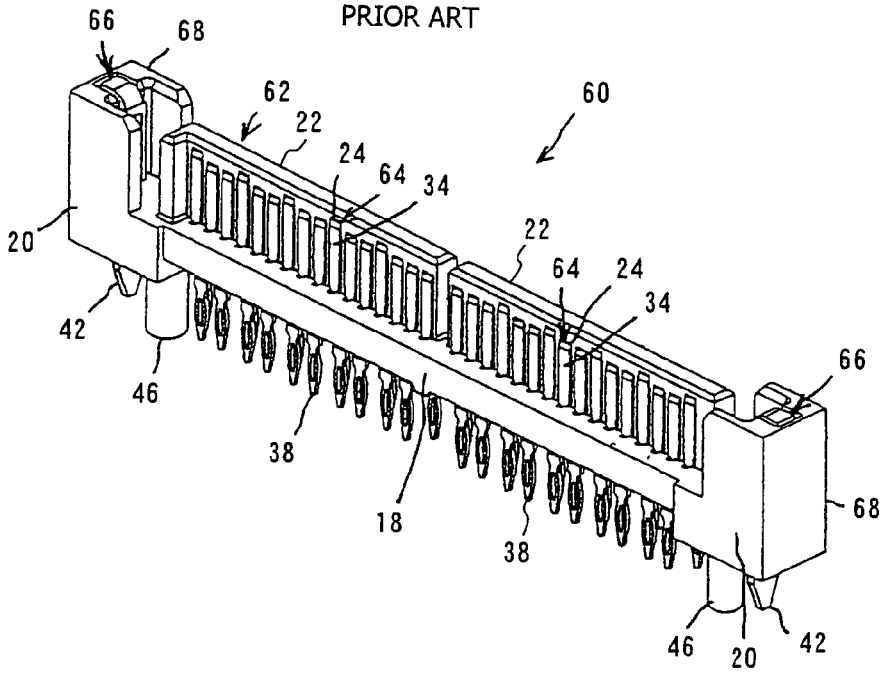
FIG. 7A PRIOR ART
FIG. 7A is a perspective view of the electrical connector of the prior art viewed from the side of the fitting portion.
Figure 7B:
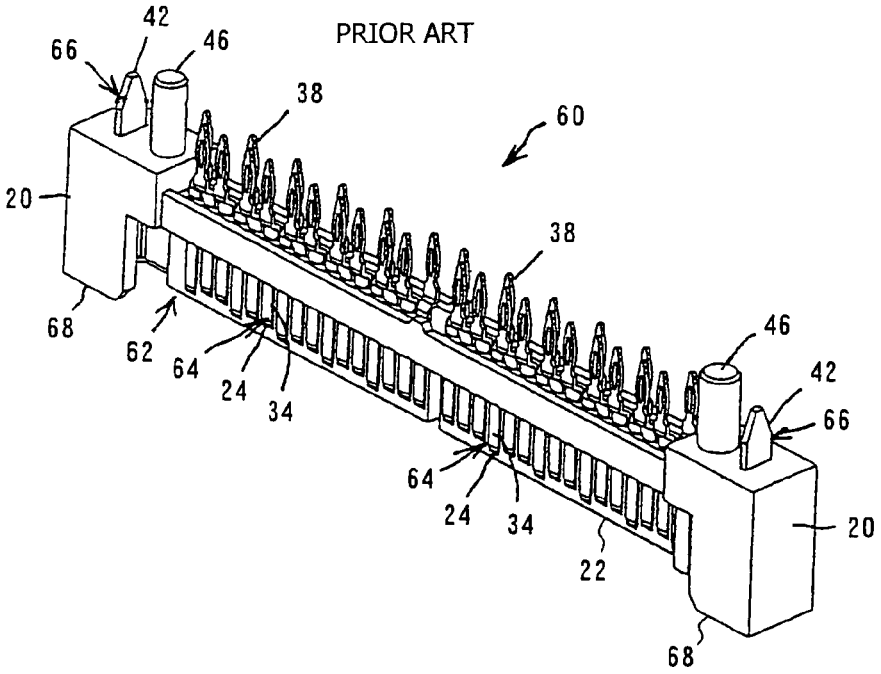
FIG. 7B PRIOR ART
FIG. 7B is a perspective view of the electrical connector shown in FIG. 7A viewed from the side of the connection portion.

Embodiments of the electrical connector 10 according to the invention will be explained with reference to FIGS. 1A to 6. FIG. 1A is a perspective view of the electrical connector according to the invention viewed from the side of fitting portion to be fitted with a mating connector, and FIG. 1B is a perspective view of the electrical connector shown in FIG. 1A, viewed from the side of connection portions of contacts. FIG. 2 is a perspective view of a fixture of the electrical connector. FIG. 3 is a perspective view of a housing of the electrical connector. FIG. 4 is a perspective view of a contact of the electrical connector. FIG. 5A is a perspective view of an electrical connector according to the invention using other fixtures viewed from the side of the fitting portion, while FIG. 5B is a perspective view of the electrical connector shown in FIG. 5A viewed from the side of the connection portions of the contacts. FIG. 6 is a perspective view of the electrical connector according to the invention with a mating connector fitted with each other. The electrical connector 10 according to the invention comprises a housing 12, contacts 14 and fixtures 16.

The component parts of the electrical connector 10 according to the invention will be explained with reference to the drawings. First, the fixtures 16 will be explained. The fixtures 16 are made of a metal and formed by means of the press-working of the known technique. Preferred metals from which to form the fixtures 16 include brass, beryllium copper, phosphor bronze and the like which comply with the requirements such as springiness, electric conductivity and the like. Said fixture 16 mainly comprises a guide portion 40 and a connection portion 42.

Said fixture 15 comprises said guide portion 40 for guiding a mating connector 80, the guide portion 40 being formed integrally which said connection portion 42 to be connected to a substrate. Said guide portion 40 has a substantially U-shaped cross-section formed by a central wall and a pair of opposite side walls, having facing inner surfaces and oppositely facing outer surfaces, and the size of said guide portion 40 may be suitable designed in consideration of the size of a mating connector 80. As shown in FIG. 2, moreover, one free end of said guide portion 40 is provided on each of its both sides with an extending piece 44 which extends downwardly and is adapted to be inserted into an inserting groove or aperture 28 of said housing 23. Said extending pieces 44 inserted into the inserting grooves 28 of said housing 12 serve to increase the fitting strength of the fixtures 16 with the housing 12 for resisting to the unexpected strong forces. The size and shape of said extending pieces 44 may be suitably designed in consideration of their function described above, miniaturization of the electrical connector 10, strength of said housing 12, and the like. As seen in FIG. 6, when connectors 10 and 80 are connected they have facing surfaces respectivelv which are moveable towards each other along a first axial direction and said extending portion 42 extends transversely of said axial direction.

Although said connection portions 42 bent in a substantially L-shape are of a surface mounting type (SMT) in the illustrated embodiment, it is to be understood that they may be of a dip type or a press-in type. Said fixtures 16 are fixed to said housing 12 by means of press-fitting.

Moreover, said fixture 16 is provided with an engaging portion 41 which is adapted to engage an anchoring portion 82 of the mating connector 80. The shape and size of said engaging portion 41 are not limited insofar as it is able to engage the anchoring portion 82 of the mating connector 80, and may be suitably designed in consideration of conformity with the anchoring portion 82, strength of said fixture 16, holding strength for the mating connector 80 to be fitted, and the like. In the illustrated embodiment, the engaging portion 41 is in the form of a hole for facilitating the engagement of the anchoring portion 82 of the mating connector, which is substantially in the form of an L-shape.

Said housing 12 will then be explained. The housing 12 is formed from an electrically insulating plastic material by means of the injection molding of the known technique. The materials for the housing 12 may be suitably selected in consideration of dimensional stability, workability, manufacturing cost and the like and generally include polybutylene terephthalate (PBT), polyamide (66PA or 46PA), liquid crystal polymer (LCP), polycarbonate (PC) and the like and combination thereof. Said housing 12 mainly comprises a main body 18, flanges 20, and a fitting portion 22.

As shown in FIG. 3, said housing 12 is substantially of a plate shape. Said housing 12 is provided with the fitting portion 22 extending from the main body 18, which is adapted to be fitted with the mating connector 80. The fitting portion 22 is formed with inserting holes 24 in a manner communicating with said main body 18, into which said contacts 14 are inserted. The size of said inserting holes 24 may be suitably designed in consideration of the size of said contacts 14 and a method for fixing said contacts 14 into the inserting holes 24. The shape of said fitting portion 22 may be designed so as to be adapted to said mating connector 80. In the illustrated embodiment, said fitting portion 22 is divided into two parts, and the one part is provided with a ridge at its outermost end so as to have an L-shaped cross-section for the purpose of preventing the mating connector from being erroneously fitted.

Said housing 12 includes at longitudinal ends the flanges 20 provided contiguously to the main body 18. Said flanges 20 are each provided with the inserting groove 28 at a location corresponding to said extending piece 44 which is inserted into the inserting groove 28. The shape and size of said inserting groove 28 may be suitably designed so as to be adapted to said extending piece 44 in consideration of the function of the extending piece 44. In the case that said extending pieces 44 are as shown in FIG. 2, said inserting grooves 28 may be blind holes or through-holes. In the embodiment as shown in FIG. 5, the inserting grooves 28 are through-holes.

As seen in FIG. 3, said housing 12 is provided with slits 32, one at each of the longitudinal ends, to form spaced apart holding portions 26 having elasticity, which enable said guide portions 40 of said fixtures 26 to be held between facing surfaces of said holding portions which are elastically deflectable. The sizes of said holding portions 26 and said slits 32 may be suitably designed in consideration of the holding force for said fixtures 16, strength of said housing 13, the elasticity of said holding portions, and the like. The flanges 20 at each of the longitudinal ends of the housing 12 are provided with a positioning pin 46 for positioning said connector 10 relative to the substrate in the connection direction of fixture 16. Said positioning pins 46 not only contribute to the positioning of connector 10 to the substrate but also serve to prevent said contacts 16 from being deformed and damaged by insertion of the positioning pins 46 into holes of the substrate before the connection portions 38 of said contacts 14 contact the substrate. This function preventing the deformation and damage of the contacts 14 is particularly effective in the case that the connection portions 38 of said contacts 16 are of a dip type or press-in type. The shape and size of said positioning pins 46 may be suitably designed in consideration of such functions, strength of the positioning pins 46, and the like. In order to obtain a sequence construction in the illustrated embodiment, the inserting holes 24 of said housing 12 are varied to obtain various depths of press-fitted contacts thereby changing contact positions of the contacts and hence shifting the timing of contact with the mating connector 80 by the variant positions of the contacts according to customers' specifications.

Finally, the contacts 14 will be explained. The contacts 14 are made of a metal and formed by means of the press-working of the known technique. Preferred metals from which to form the contacts 14 include brass, beryllium copper, phosphor bronze and the like which comply with the requirements such as springiness, electric conductivity and the like.

Said contact 14 is substantially of an L-shape as shown in FIG. 4. Said contact 14 comprises a contact portion 34 adapted to contact the mating connector 80, a fixed portion 36 to be fixed to said housing 12, and a connection portion 38 to be connected to the substrate. Since the depths of press-fitted contacts in the inserting holes 24 of the housing 12 are varied to obtain the sequence construction as described above, only one kind of contacts is required. Said contacts 14 may be fixed to said housing 12 by press-fitting, hooking (lancing), molding the housing together with the contacts arranged in a mold, or welding, and are fixed by press-fitting in the illustrated embodiment. Although said connection portions 38 of said contacts 14 are of a surface mounting type (SMT) in the illustrated embodiment, it is to be understood that they may be of a dip type or press-in type.

Moreover, an electrical connector 10 using other fixtures 16 will be explained with reference to FIGS. 5A and 5B hereafter. As components of this electrical connector 10 except for the fixtures 16 are substantially the same as those described above, these components will not be described further, and differences in the fixtures 16 only will be explained. The fixtures 16 in the present embodiment is also provided with extending pieces or projection or leg 44 extending from a guide portion 40. The inserting grooves or apertures 28 of the housing 12 are formed through-holes. The extending pieces 44 are extended through the inserting grooves 28 of the housing 12, and tips of the extending pieces 44 extending from the housing are each provided with a connection portion 42 to be connected to the substrate, this substrate-engaging portion extending transversely of said axial direction. By providing the connection portion 42 at each of the tips of the extending pieces 44, the fixture is fixed to the substrate at three points so that the strength of the fixtures is increased with the aid of such a connection to the substrate, and the strength of the mounting on the substrate is also increased. Moreover, the connection portions 42 provided on the tips of said extending pieces 44 are of a dip type in the embodiment shown in FIGS. 5A and 5B. The connection portions 42 provided on the tips of said extending pieces 44 are preferably of a dip type or press-in type in consideration of the function of said extending pieces 44 and the insertion of the extending pieces 454 into said housing 12. However, since bending working of the connection portions 42 is possible even after said extending pieces 44 have been inserted, the surface mounting type (SMT) may also be employed.

As seen in FIG. 6, when mating connector 80 is moved downward for its contacts to electrically engage contacts of connector 10, facing surfaces of said connectors are moved along a directional plane between them, with connector 80's movement guided by fixtures 16 at opposite ends of connector 10. Each fixture 16 is formed as a channel of U-shape cross-section whose walls extend lengthwise and in the direction of said directional plane of movement of connector 80 to connector 10.

Examples of applications of the invention are electrical connectors for use in electric and electronic appliances such as servers and the like, and more particularly connectors being capable of resisting to unexpected strong forces when the connector is being fitted with a mating connector.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A first electrical connector adapted to be detachably connected to a mating electrical connector and to a substrate, where said first and mating electrical connectors have facing surfaces which are movable toward each other along a first axial directional between said facing surfaces when said electrical connectors are connected, said first electrical connector comprising:

a. a longitudinal housing which has opposite ends and a plurality of electrical contacts mounted to said housing between said ends thereof, and has at each end a holding portion for guiding and securing said mating electrical connector to said first connector and for fixing said first electrical connector to a substrate, each of said holding portions comprising a pair of spaced-apart flanges (i) extending from said housing in said first axial direction, (ii) being elastically deflectable in a direction transverse of said first axial direction, and (iii) having facing spaced-apart holding surfaces respectively, and b. a fixture securable to each of said ends of said housing, each of said fixtures having a guide portion of generally U-shape cross-section comprising a central wall and a pair of opposite side walls having facing inner surfaces and oppositely facing outer surfaces, said guide portion of each of said fixtures attachable to one of said holding portions of said housing with said outer surfaces of said side walls of said guide part adjacent and engaging said holding surfaces of said flanges which are thereby elastically deflected, said fixture further comprising a substrate-engaging portion extending transversely of said axial direction.

2. A first electrical connector according to claim 1 wherein, for each of said holding portions of each of said fixtures, each of said side walls further comprises a projection extending in said axial direction and adapted to be inserted into a corresponding aperture in one of said end parts of said housing.

3. A first electrical connector according to claim 1 wherein said mating connector has opposite ends with an anchoring portion on each of said opposite ends, and each of said fixtures when secured to said first connector's end part, has an engaging portion adapted for engagement with said corresponding anchoring portion.

4. A first electrical connector according to claim 1 wherein said engaging portion is an aperture and said anchoring portion extends transversely of said axial direction and is insertable into said aperture.

5. A first electrical connector according to claim 4 wherein said aperture is situated in said central wall of said holding portion.

6. A first electrical connector according to claim 3 where said anchoring portion and engaging portions are engageable for locking together said first and mating electrical connectors when they are connected together.

7. A first electrical connector according to claim 1 wherein said substrate engaging portion comprises a leg portion extending transversely from said central wall portion of said holding portion.

8. A first electrical connector adapted to be detachably connected to a mating electrical connector and to a substrate, where said first and mating electrical connectors have facing surfaces which are movable toward each other along a first axial directional between said facing surfaces when said electrical connectors are connected, said first electrical connector comprising:

a. a longitudinal housing which has opposite ends and a plurality of electrical contacts mounted to said housing between said ends thereof, and has at each end a holding portion for guiding and securing said mating electrical connector to said first connector and for fixing said first electrical connector to a substrate, each of said holding portions comprising a pair of spaced-apart flanges (i) extending from said housing in said first axial direction, (ii) being elastically deflectable in a direction transverse of said first axial direction, and (iii) having facing spaced-apart holding surfaces respectively, and b. a fixture securable to each of said ends of said housing, each of said fixtures having a guide portion of generally U-shape cross-section comprising a central wall and a pair of opposite side walls having facing internal surfaces and oppositely facing external surfaces, said guide portion of each of said fixtures attachable to one of said holding portions of said housing with said external surfaces of said side walls of said guide part adjacent and engaging said holding surfaces of said flanges which are thereby elastically deflected.

* * * * *